US005243136A

United States Patent [19]

Chen

[11] Patent Number: 5,243,136

[45] Date of Patent: Sep. 7, 1993

[54] ELECTRIC POWER CORD WITH DOUBLE-OUTPUT TERMINAL

[75] Inventor: Y. C. Chen, Yeong-Ho, Taiwan

[73] Assignee: King-Cord Co., Ltd., Taiwan

[21] Appl. No.: 817,613

[22] Filed: Jan. 7, 1992

[51] Int. Cl.[5] ..... H01B 7/00

[52] U.S. Cl. ..... 174/72 C; 174/72 R; 174/135; 174/71 R; 174/69

[58] Field of Search ..... 174/72 C, 71 R, 72 R, 174/135, 92, 138 F, 68.3, 155, 156, 70 R, 117 R, 117 F, 69; 439/282, 502, 503, 504, 505, 506, 623, 624

[56] References Cited

U.S. PATENT DOCUMENTS 3,634,655 1/1972 Jordan ..... 174/69 X
4,049,357 9/1977 Hamisch ..... 403/209
4,219,693 8/1980 French ..... 174/135
4,234,760 11/1980 Lawson ..... 174/138 F

*Primary Examiner*—Leo P. Picard
*Assistant Examiner*—Hyung S. Sough
*Attorney, Agent, or Firm*—Bacon & Thomas

[57] ABSTRACT

An electric power cord with double-output terminal, comprising a casing formed of two symmetrical shells connected by bolts and retaining holes thereof, said symmetrical shells each having two arch-shaped vertical side walls symmetrically curving outwards at two opposite locations with a power input port therebetween and fastened with a first cable for connecting to a socket power and a straight vertical side wall at a right angle relative to said two arch-shaped vertical side walls and defined therewith two output ports fastened with a second cable and a third cable respectively for connecting said socket power to two separate electric appliances.

4 Claims, 4 Drawing Sheets

ELECTRIC POWER CORD WITH DOUBLE-OUTPUT TERMINAL

BACKGROUND OF THE INVENTION

The present invention relates to electric power cords and relates more particularly to such an electric power cord which has two output ports for connecting a power supply to two separate electric or electronic devices.

In a computer system, as illustrated in FIG. 1, the mainframe has a power input terminal connected to a power supply by an electrical power cord, a power output terminal and a single output terminal for connecting the power input terminal and the signal input terminal of a monitor. If a color monitor is used, the power input port of a color monitor should be directly connected to the power supply by a separate electrical power cord, i.e. two separate electrical power cords should be connected to two outlets of the power supply by two plugs respectively.

The present invention has been accomplished under the aforesaid circumstances in view. It is therefore the main object of the present invention to provide an electric power cord which has one power input terminal for connecting to a socket power and two power output terminals for connecting said socket power to two separate electric appliances.

SUMMARY OF THE INVENTION

According to the present invention, there is provided an electric power cord comprised of a casing consisted of two symmetrical shells. The shells each has a plurality of male fastening means and female fastening means on each of the three vertical side walls thereof. By fastening the male and female fastening means of a first shell with the female and male fastening means of a second shell, the two shells are connected together and formed into the casing which has three ends fastened with three cables, namely, a power input cable at one end for connecting to a socket power, and two power output cables at the other two ends for connecting the socket power to two separate electric appliances, for examples, a computer mainframe and a monitor.

DETAILED DESCRIPTION OF THE PREFERRED EMBODIMENT

Figure 1:
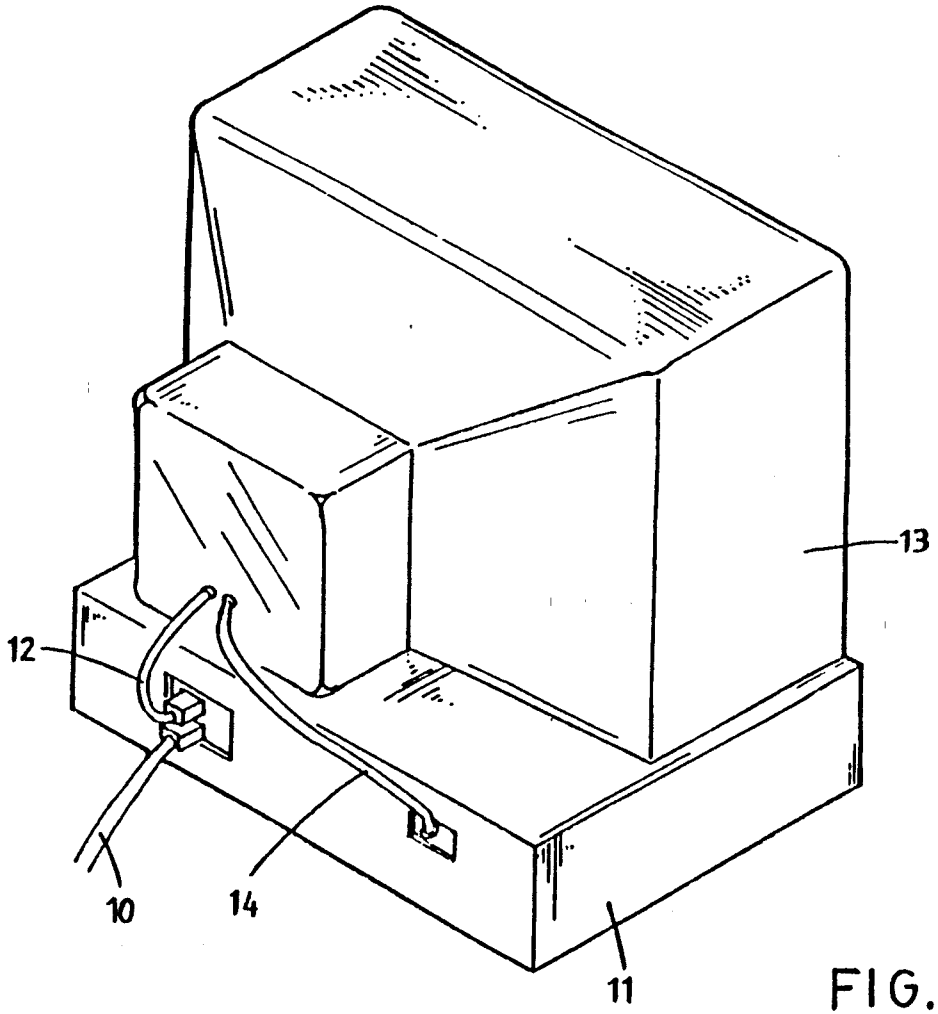
FIG. 1 (PRIOR ART)
FIG. 1 is a back view of a computer system showing a power line connection according to the prior art.
Figure 2:
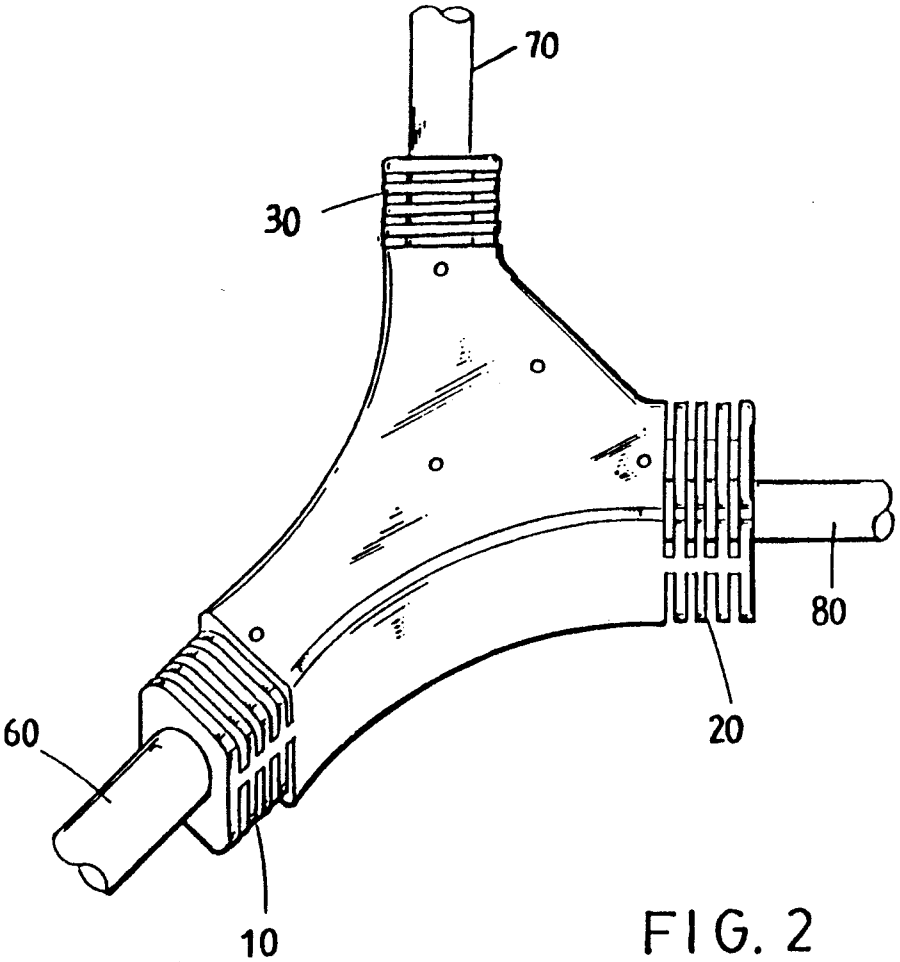
FIG. 2 is a perspective view of the casing of the preferred embodiment of the electric power cord of the present invention.
Figure 3:
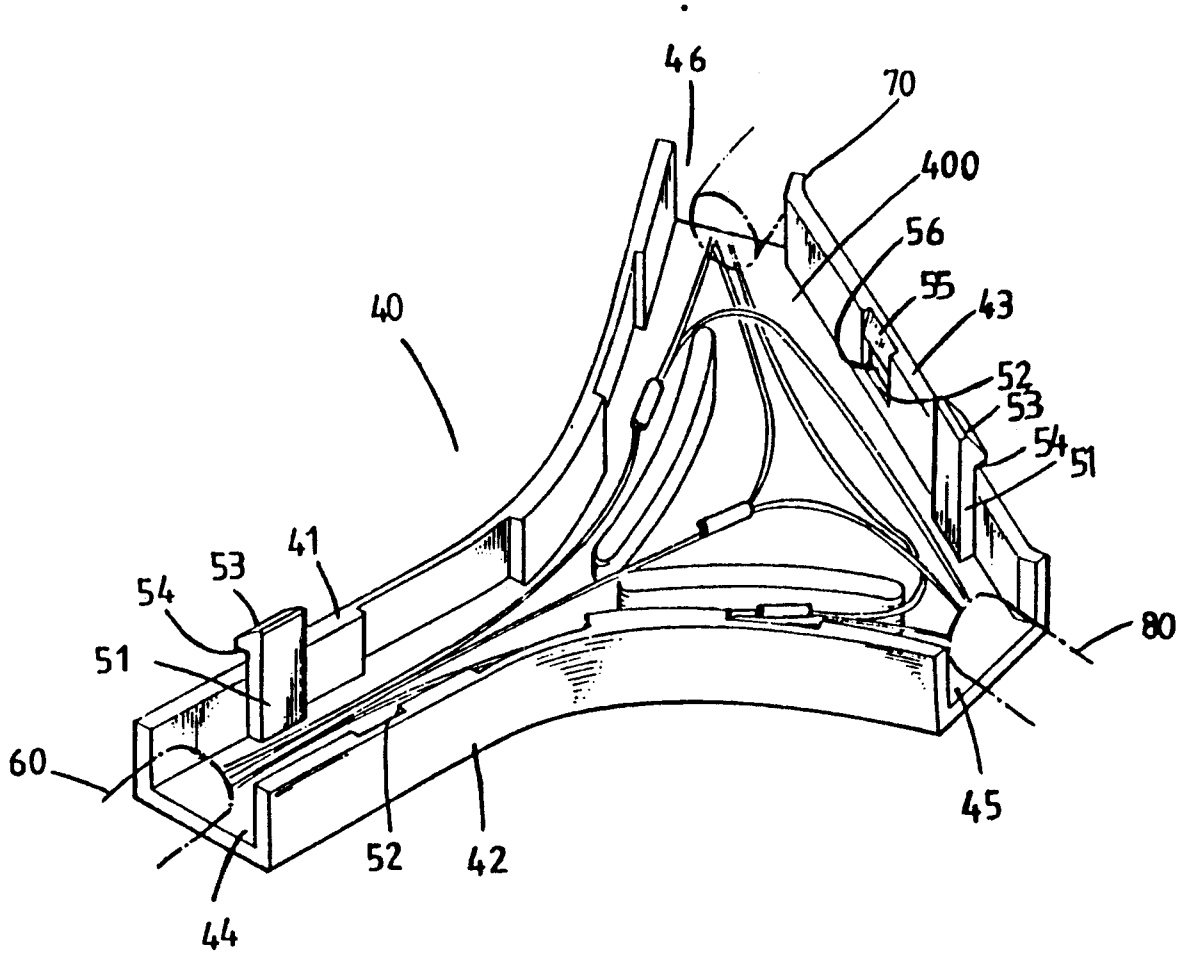
FIG. 3 is a perspective view of one shell of the casing showing its internal structure.
Figure 4:
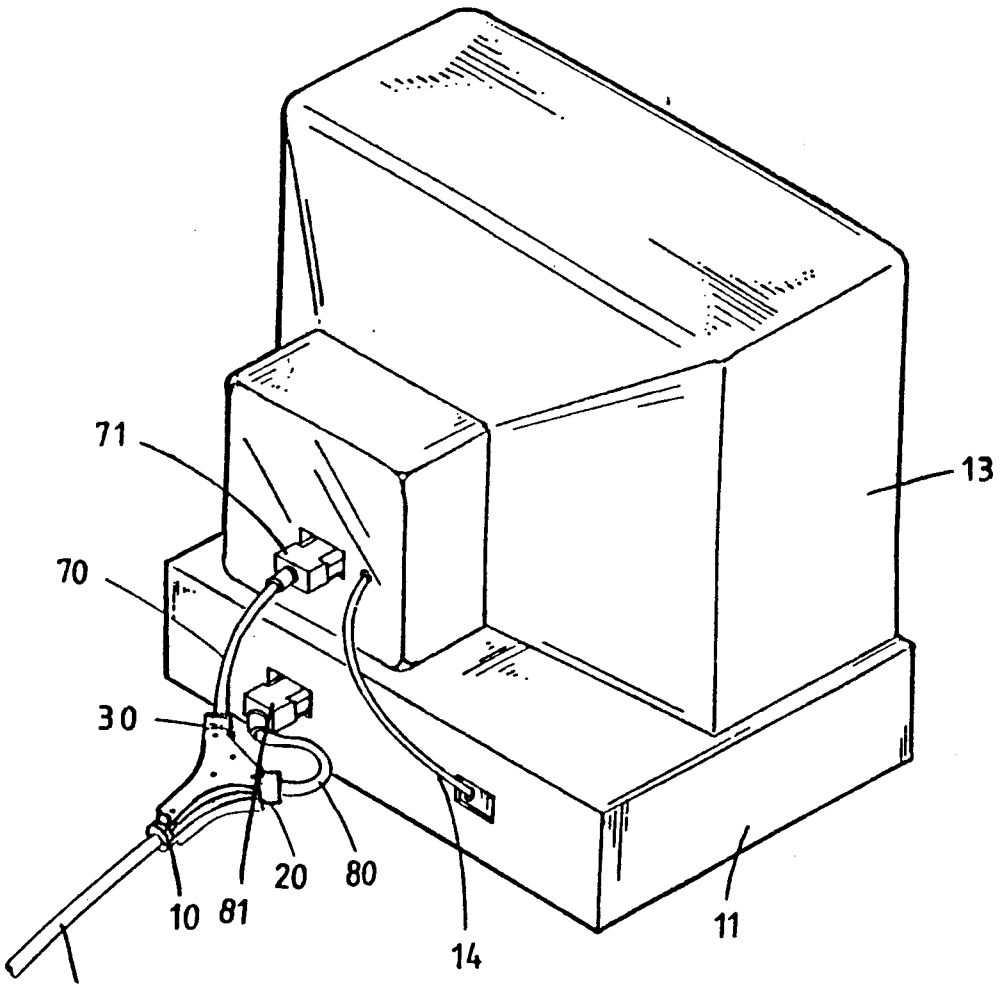
FIG. 4 illustrates that the present invention is used in connecting a computer mainframe and a monitor to a common socket power.

Referring to FIGS. 2 and 3, two symmetrical shells 40 are connected into a casing and molded with three flexible terminals 10, 20, 30 at three ends thereof through the process of injection molding, which terminals 10, 20, 30 are to be connected to a power supply, a power input port on a monitor and a power input port on a computer mainframe by cables 60, 70, 80 respectively.

Referring to FIG. 3 again, the shells 40 each is comprised of a flat bottom surface 400 having three vertical side walls 41, 42, 43 raising from the peripheral edge thereof. The vertical side walls 41, 42 are symmetrically curving outwards with a wire hole 44 defined therebetween at one end. The vertical side wall 43 is made in a straight line defined with the vertical side walls 41, 42 two separate wire holes 45, 46. Each shell 40 further comprises a plurality of unitary male fastening means 51 and female fastening means 52 on each of the vertical side walls 41, 42, 43 thereof. Each male fastening means 51 protrudes over the topmost edge of either vertical side wall terminating into an outward sloping roof 53 and an outward shoulder 54. Each female fastening means 52 is consisted of a sloping edge 55 and a retaining hole 56. By fastening the male fastening means 51 of one shell into the female fastening means 52 of the other shell, the sloping roof 53 of each male fastening means 51 will be guided by the sloping edge 55 into the retaining hole 56 causing the two symmetrical shells 40 to be firmly secured together and formed into a casing having three wire holes 44, 45, 46 for fastening three cables 60, 70, 80.

Referring to FIG. 5, the cable 60 is connected to a power supply (not shown), the cable 80 is coupled with a plug 81 connected to the power input port on a computer mainframe 11, the cable 70 is coupled with a plug 71 connected to the power input port on a monitor 13 (which has a signal input port connected to a signal output port on the computer mainframe 11 by a cable 14). Therefore, the computer mainframe 11 and the monitor 13 can be connected to a common power supply outlet by the electric power cord of the present invention.

What is claimed is:

1. An electric power cord having two output ports for connecting a power supply to two separate electric appliances, comprising a casing consisting of two symmetrical shells connected by a plurality of fastening means, said two symmetrical shells each comprised of a flat bottom surface having two symmetrical arch-shaped vertical sidewalls and a straight, vertical sidewall rising from the peripheral edge thereof with a first wire hole defined between said two symmetrical, arch-shaped vertical sidewalls for fastening a first cable, a second wire hole defined between one of said two symmetrical, arch-shaped vertical sidewalls and said straight, vertical sidewall for fastening a second cable, and a third wire hole defined between the other of said two symmetrical arch-shaped vertical sidewalls and said straight, vertical sidewall for fastening a third cable, each one of said three cables including a plurality of individual wires electrically connected by splices to individual wires of the other two of said cables, said splices being located in said casing, to form, together with said casing, said power cord, wherein said first cable includes means for electrically connecting said power cord to a power supply, and said second and third cables include means for respectively connecting said second and third cables to two separate electric appliances.

2. The electric power cord of claim 1, wherein said two symmetrical shells are connected together and formed into said casing and molded with three flexible terminals at three ends thereof through the process of injection molding for holding said first, second and third cables respectively.

3. The electric power cord of claim 1, wherein said fastening means comprise a plurality of male fastening means and a plurality of female fastening means, said male fastening means each comprising a bolt extending from either vertical side wall and terminated into an outward sloping roof and an outward shoulder, said female fastening means each being consisted of a sloping edge and a retaining hole formed on either vertical side wall.

4. A computer system, comprising a computer, a monitor, and an electric power cord having two output ports for respectively connecting a power supply to the computer and the monitor, said electric power cord comprising a casing consisting of two symmetrical shells connected by a plurality of fastening means, said two symmetrical shells each comprised of a flat bottom surface having two symmetrical arch-shaped vertical sidewalls and a straight, vertical sidewall rising from the peripheral edge thereof with a first wire hole defined between said two symmetrical, arch-shaped vertical sidewalls for fastening a first cable, a second wire hole defined between one of said two symmetrical, arch-shaped vertical sidewalls and said straight, vertical sidewall for fastening a second cable, and a third wire hole defined between the other of said two symmetrical arch-shaped vertical sidewalls and said straight, vertical sidewall for fastening a third cable, each one of said three cables including a plurality of individual wires each electrically connected by splices to individual wires of the other two of said cables, said splices being located in said casing, to form, together with said casing, said power cord, wherein said first cable includes means for electrically connecting said power cord to a power supply, and said second and third cables include means for respectively connecting said second and third cables to two separate electric appliances.

* * * * *